US009347145B2

(12) United States Patent
Bessho

(10) Patent No.: US 9,347,145 B2
(45) Date of Patent: May 24, 2016

(54) METHOD OF PLATING STAINLESS STEEL AND PLATED MATERIAL

(75) Inventor: Takeshi Bessho, Toyota (JP)

(73) Assignee: TOYOTA JIDOSHA KABUSHIKI KAISHA, Aichi (JP)

( * ) Notice: Subject to any disclaimer, the term of this patent is extended or adjusted under 35 U.S.C. 154(b) by 256 days.

(21) Appl. No.: 13/699,489

(22) PCT Filed: May 23, 2011

(86) PCT No.: PCT/IB2011/001098
§ 371 (c)(1),
(2), (4) Date: Nov. 21, 2012

(87) PCT Pub. No.: WO2011/148242
PCT Pub. Date: Dec. 1, 2011

(65) Prior Publication Data

US 2013/0071688 A1 Mar. 21, 2013

(30) Foreign Application Priority Data

May 24, 2010 (JP) ..... 2010-118208

(51) Int. Cl.

| | |
|---|---|
| ***C25D 5/10*** | (2006.01) |
| ***C25D 5/50*** | (2006.01) |
| ***C23C 28/02*** | (2006.01) |
| ***C25D 5/14*** | (2006.01) |
| ***C25D 5/34*** | (2006.01) |

(Continued)

(52) U.S. Cl.
CPC . *C25D 5/10* (2013.01); *C23C 28/02* (2013.01); *C23C 28/028* (2013.01); *C25D 5/14* (2013.01); *C25D 5/34* (2013.01); *C25D 5/36* (2013.01); *C25D 5/50* (2013.01); *C25D 7/00* (2013.01); *Y10T 428/12944* (2015.01)

(58) Field of Classification Search
CPC ..... C25D 5/10; C25D 5/14
USPC ..... 148/518
See application file for complete search history.

(56) References Cited

U.S. PATENT DOCUMENTS

| | | | | |
|---|---|---|---|---|
| 5,312,026 | A | 5/1994 | Yamanashi | |
| 5,679,181 | A | 10/1997 | Ohmura et al. | |
| 6,555,178 | B2 * | 4/2003 | Harakawa et al. | 427/443.1 |

(Continued)

FOREIGN PATENT DOCUMENTS

| | | | |
|---|---|---|---|
| CA | 1038245 | A1 | 9/1978 |
| CN | 1322857 | A | 11/2001 |

(Continued)

OTHER PUBLICATIONS

Machine translation of JP2000026992A, Jan. 2000.*
Rabizadeh, An investigation on effects of heat treatment on corrosion properties of Ni—P electroless nano-coatings, Materials and Design, 2010, vol. 31, p. 3174-3179.*

(Continued)

*Primary Examiner* — Jie Yang
*Assistant Examiner* — Xiaowei Su
(74) *Attorney, Agent, or Firm* — Sughrue Mion, PLLC

(57) ABSTRACT

The method of plating a stainless steel substrate including depositing a first plating metal layer over the stainless steel substrate), forming an interdiffusion layer in which elements of the stainless steel substrate and elements of the first plating metal layer interdiffuse, by applying a heat treatment to the stainless steel substrate coated by the first plating metal layer, and coating a second plating metal layer over the surface of the stainless steel substrate over which the interdiffusion layer is coated.

6 Claims, 5 Drawing Sheets

(51) Int. Cl.
*C25D 5/36* (2006.01)
*C25D 7/00* (2006.01)

(56) References Cited

U.S. PATENT DOCUMENTS

| | | | |
|---|---|---|---|
| 6,982,011 | B1 | 1/2006 | Pfeifenbring et al. |
| 2001/0025149 | A1 | 9/2001 | Kobayashi et al. |
| 2005/0108878 | A1 | 5/2005 | Nishimura et al. |
| 2005/0112459 | A1 | 5/2005 | Ohmura et al. |
| 2006/0266444 | A1 | 11/2006 | Kosslers et al. |
| 2008/0308425 | A1 | 12/2008 | Mittendorf et al. |

FOREIGN PATENT DOCUMENTS

| | | | | |
|---|---|---|---|---|
| JP | 03166388 | A | | 7/1991 |
| JP | 06240622 | A | | 8/1994 |
| JP | 10-265938 | A | | 10/1998 |
| JP | 11287227 | A | | 10/1999 |
| JP | 2000026992 | A | * | 1/2000 |
| JP | 2001269346 | A | | 10/2001 |
| JP | 2001-355077 | A | | 12/2001 |
| JP | 2004205059 | A | | 7/2004 |
| JP | 2005155673 | A | | 6/2005 |
| JP | 2007254848 | A | | 10/2007 |
| JP | 2009-035811 | A | | 2/2009 |

OTHER PUBLICATIONS

Narayanan, Materials Chemistry and Physics, 2003, vol. 82, p. 771-779.*

Z. Abdel Hamid et al: "Enhancement of the properties of austenitic stainless steel by nickel diffusion coatings", Anti-Corrosion Methods and Materials, vo. 50, No. 2, Jan. 1, 2003, pp. 115-120, XP55015447, ISSN: 0003-5599, DOI: 10.1108/00035590310463975.

H.-G. Schenzel et al: "Increasing the corrosion resistance of chemically deposited nickel-phosphorus coatings", Galvanotechnik, vol. 81, No. 5, May 1998, pp. 1655-1658, XP008146800.

M. Sadeghi et al: "Effects of Heat Treatment on the Structure, Corrosion Resistance and Stripping of Electroless Nickel Coatings", Transactions of the Institute of Metal Finishing, vol. 61, 1983, XP008146801.

International Search Report and Written Opinion for corresponding International Patent Application No. PCT/IB2011/001098 mailed Jan. 4, 2012.

International Preliminary Report on Patentability for corresponding International Patent Application No. PCT/IB2011/001098 mailed Jun. 5, 2012.

Narayanan et al.,"Electroless Ni—P/Ni—B Duplex Coatings: Preparation and Evaluation of Microhardness, Wear and Corrosion Resistance", Materials Chemistry and Physics, vol. 82, No. 3, Dec. 1, 2003, pp. 771-779.

* cited by examiner

FIG. 4

| | CORROSION TEST (pH 3.5) | CORROSION TEST (pH 7.0) |
|---|---|---|
| EXAMPLE 1 | 3 μm | 0 μm (NO RUST DEVELOPMENT) |
| COMPARATIVE EXAMPLE 1 | 81 μm | 43 μm |
| COMPARATIVE EXAMPLE 2 | 73 μm | 40 μm |

METHOD OF PLATING STAINLESS STEEL AND PLATED MATERIAL

FIELD OF THE INVENTION

The present invention relates to a method of plating a surface of a stainless steel and a plated material therefor, and particularly to a method of plating a highly corrosion-resistant stainless steel and a plated material.

BACKGROUND OF THE INVENTION

The surfaces of steel products under corrosive environments, such as automotive parts, are coated with plating films (plating metal layers) such as zinc, nickel, and chromium to reduce corrosion of the steel substrate. Under a mildly corrosive environment, steel is generally coated with zinc plating or the like that provides sacrificial corrosive effect. However, under a harsh corrosive environment such as a strongly acidic atmosphere, simply applying plating with the sacrificial corrosive effect may not sufficiently prevent progress of corrosion of the steel substrate.

Accordingly, a method has been adopted in which a highly corrosion-resistant stainless steels are used in steel products and further the stainless steel as a base material is coated with a plating metal layer (barrier plating metal layer) of a highly corrosion-resistant metal. As an example of such a method, Japanese Patent Application Publication No. 2004-205059 (JP 2004-205059) describes a method of plating a stainless steel substrate, in which a phosphorus-containing nickel film is deposited on the surface of a ferritic or austenitic stainless steel plate by electroless plating and subsequently the phosphorus-containing nickel is diffused into the interior thereof by heat treatment. In accordance with this plating method, although nickel of the phosphorus-containing nickel film (nickel plating layer) crystallizes by the heat treatment, since the nickel plating layer is coated over the surface of the stainless steel, the corrosion resistance of the stainless steel is improved.

However, even if a plating layer such as a nickel plating layer is provided over the surface of the stainless steel as disclosed in JP 2004-205059, the plating layer may corrode if it is exposed to a strongly acidic environment at, for example a pH of 2-3 for a long period.

If corrosion of the plating layer further progresses, corrosion reaches the surface of the stainless steel substrate (base material). At this point, since the stainless steel is a baser metal than the material of the plating layer, when corrosion further progresses, as shown in FIG. 5, the stainless steel falls into a corrosion state with pitting corrosion. When corrosion further progresses in the thickness direction of the stainless steel from such a state, corrosion holes pass through the interior of the stainless steel. As a result, a part made of the stainless steel may lose its original function. In the case that the stainless steel without plating is used, a passivation film of chromium oxide will form. In this case as well, the stainless steel falls into a corrosion state with pitting corrosion similar to FIG. 5.

Further, small holes that extend from the surface of the plating layer of nickel or the like to the interior, which is referred to as pinholes, are slightly formed in such a plating layer. A corrosive liquid such as an acid solution infiltrates via the pinholes. Pitting corrosion may thereby occur in the stainless steel substrate (base material) as described above.

SUMMARY OF THE INVENTION

The present invention provides a method of plating a stainless steel substrate which can prevent pitting corrosion of the stainless steel substrate in a harsh corrosive environments is reduced and plated material therefor.

A first aspect of the present invention relates to a method of plating a stainless steel. The method of plating includes: coating a first plating metal layer over a stainless steel; forming an interdiffusion layer in which elements of the stainless steel and elements of the first plating metal layer interdiffuse, by applying a heat treatment to the stainless steel coated by the first plating metal layer; and coating a second plating metal layer over the stainless steel having the interdiffusion layer formed therein.

As described above, the first plating metal layer is first coated over the stainless steel (member made of stainless steel). The interdiffusion layer is next formed by use of the first plating metal layer. In other words, the heat treatment is applied to the stainless steel coated with the first plating metal layer, thereby the elements of the first plating metal layer diffuse from the interface to the stainless steel to the interior of the stainless steel, and the elements (Fe, Cr, C, and so forth) of the stainless steel also diffuse from the interface of the first plating metal layer to the interior of the first plating metal layer. In the above-described method, the layer having the elements of both the materials interdiffused therein is referred to as the interdiffusion layer. The second plating metal layer is next coated over the stainless steel having the interdiffusion layer formed therein.

In the plated material in which plating is applied to the stainless steel in such a manner, the metals that form the interdiffusion layer are baser metals (metals having higher ionization tendencies) than the metals that form the second plating metal layer, and thus the interdiffusion layer serves as a sacrificial corrosive layer. Accordingly, the interdiffusion layer corrodes before corrosion progresses to the base material made of stainless steel. As a result, corrosion progresses in the direction along the surface of the base material made of stainless steel, and corrosion in the thickness direction of the base material made of stainless steel, that is, pitting corrosion of the base material made of stainless steel can be thus prevented. Herein, "plating metal layer" is a layer whose main material is a metallic material.

Further, the elements of the stainless steel can be diffused into the first plating metal layer by heat treatment so that a part or all of the first plating metal layer becomes the interdiffusion layer. In a more preferable embodiment, in the above-described method of plating stainless steel, the elements of the stainless steel can be diffused to the surface of the first plating metal layer in the forming of the interdiffusion layer.

In other words, the method is that the elements of the stainless steel are diffused throughout the first plating metal layer. In accordance with the above method, since the elements of the stainless steel are diffused to the surface of the first plating metal layer, iron is present in this surface (the surface of the interdiffusion layer). Accordingly, the adhesive strength of the second plating metal layer coated over this surface is further improved compared to a plating metal layer having no iron on its surface.

It is common to remove the passivation film (a chromium oxide film specific to stainless steels, which is formed by oxidation in the atmosphere) before coating the first plating metal layer. In the method of plating a stainless steel, the passivation film formed on the surface of the stainless steel may be removed by electrolytic plating, and a plating metal layer of the same kind of plating metal as the first plating metal layer may be also coated over the surface from which the passivation film has been removed, before coating the first plating metal layer.

In accordance with the method, the passivation film can be removed in the same plating bath by electrolytic plating, and the plating metal layer (strike plating layer) of the same kind as the first plating metal layer can be coated. Accordingly, since the stainless steel is not exposed to the atmosphere after the removal of the passivation film, the plating metal layer with high adhesive strength (strike plating layer) can be formed in a state in which the passivation film is hindered from forming again. Further, since the plating metal layer of the same kind is formed, the adhesive strength of the first plating metal layer can be also improved. Herein, "plating metal of the same kind as the plating metal of the first plating metal layer" means that the metal to be the main material is the same. For example, the first plating metal layer may be nickel-based metals (i.e. nickel or compounds having nickel as their main material). In this case, the plating metal to be plated is a nickel-based metal.

The plating metal of the first plating metal layer is not specifically limited if the plating metal does not melt in the heat treatment for forming the interdiffusion layer and the elements that form the metal diffuse into the stainless steel, but is preferably a nobler metal (metals having lower ionization tendencies) than the stainless steel. For example, examples of the plating metal of the first plating metal layer are nickel, chromium, tin, palladium, alloy metals of those, and so forth. The plating metal of the first plating metal layer may be a nickel-based metal. Nickel based metals (nickel and compounds having nickel as their main material) are more versatile than other metals, and can diffuse nickel into stainless steel without melting in the heat treatment for forming the interdiffusion layer and further without sensitization of stainless steel.

Further, the stainless steel is not specifically limited, but may be a ferritic stainless steel, austenitic stainless steel, martensitic stainless steel, or the like. In the step for forming the interdiffusion layer, the temperature condition of the heat treatment is not specifically limited if the elements of the stainless steel and the elements of the first plating metal layer can interdiffuse.

The stainless steel may be an austenitic stainless steel. In the step for forming the interdiffusion layer, the heat treatment can be applied by heating the stainless steel at a temperature in the range of 800° C. to 1100° C.

In accordance with the method, intergranular corrosion or the like by acids can be prevented by the use of an austenitic stainless steel, and sensitization of the stainless steel can be also prevented by heating the austenitic stainless steel in such a heat treatment condition. In other words, when the heat treatment temperature is from 600° C. to lower than 800° C., Cr carbide deposits in the austenite grain boundary, and a Cr-depleted layer is formed in a vicinity of the grain boundary, resulting in sensitization of the stainless steel. Accordingly, the stainless steel after the heat treatment becomes prone to intergranular corrosion. The heat treatment temperature exceeding 1100° C. may also result in a similar phenomenon.

The second plating metal layer is preferably a nobler metal than the metal of the interdiffusion layer, for example, a highly corrosion-resistant metal such as Ni, Cr, Ti, W, or Sn (simple substance or alloy) that forms a strong oxidation film on its surface or an inert metal or the like such as Au, Pd, Ag, Pt, or Rh that is referred to as noble metal. The plating metal of the second plating metal layer may be phosphorus-containing nickel, and the stainless steel may be heated at 300° C. or lower after the second plating metal layer is coated. The stainless steel may be heated at 150° C. or higher.

In accordance with the method, the phosphorus-containing nickel (Ni—P) obtained by plating is highly corrosion-resistant since it is amorphous metal. By heating at 300° C. or lower, corrosion due to pinholes formed in each plating layer and the interdiffusion layer can be reduced. If the temperature of the heating condition exceeds 300° C., crystallization of the phosphorus containing nickel (Ni—P) progresses, and such crystallization may result in a reduction in corrosion resistance of the second plating metal layer. The lower limit of the heating temperature may be 150° C. or higher. Accordingly, the above-described effect can be more appropriately provided.

Etching may be applied the stainless substrate having the interdiffusion layer before the second plating layer is deposited. Accordingly, oxides or the like on the surface of the plating layer can be removed, and adhesion of the second plating metal layer in later steps can be enhanced.

A second aspect of the present invention relates to a plated material in which a stainless steel is plated. A plated material in accordance with the second aspect of the present invention is a plated material in which a stainless steel is plated and which includes an interdiffusion layer having elements of the stainless steel and elements of the plating metal layer interdiffused therein, which is formed between the stainless steel and the plating metal layer.

In the above-described plated material, since the interdiffusion layer is formed between the stainless steel and the plating metal layer, the interdiffusion layer serves as a sacrificial corrosive layer. Accordingly, since the interdiffusion layer corrodes first, corrosion progresses in the direction along the surface of the base material made of stainless steel. Corrosion in the thickness direction of the base material made of stainless steel, that is, pitting corrosion of the base material made of stainless steel can be thus prevented.

Further, the plating metal layer may be formed of a nickel-based metal, and a layer of amorphous phosphorus-containing nickel may be formed on at least a surface layer of the plating metal layer. In the plated material, since the layer of amorphous phosphorus-containing nickel is formed on the surface layer of the plated material, the corrosion resistance of the plated material can be improved.

The stainless steel of the plated material may be an austenitic stainless steel. Use of the austenitic stainless steel allows prevention of intergranular corrosion or the like, and thus allows further improvement of the corrosion resistance of the plated material.

The thickness of the interdiffusion layer may be greater than the maximum height of surface roughness of the stainless steel. Accordingly, the interdiffusion layer can uniformly cover the surface of the stainless steel.

The method of plating and plated material in accordance with the aspects of the present invention enable prevention of pitting corrosion of a stainless steel in a harsh corrosive environment.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein:

FIGS. 2A through 2E are schematic cross-sectional views of the stainless steel substrate in the steps shown in FIG. 1, in which FIG. 2A is a view illustrating a strike plating step, FIG. 2B is a cross-sectional view of the stainless steel after a first plating step, FIG 2C is a cross-sectional view of the stainless steel after a first heat treatment, FIG. 2D is a cross-sectional view after a second plating step, and FIG 2E is a cross-sectional view after a second heat treatment;

FIGS. 3A and 3B are cross-sectional views of a plated material in accordance with example 1 after an anticorrosion test, in which FIG. 3A is a cross-sectional photograph of a vicinity of a corrosion hole, and FIG. 3B is an enlarged photograph of FIG 3A;

FIG. 4 is a table showing maximum corrosion depths of the stainless steel in example and comparative examples of the present invention after corrosion tests.

DETAILED DESCRIPTION OF THE EMBODIMENTS

Figure 1:
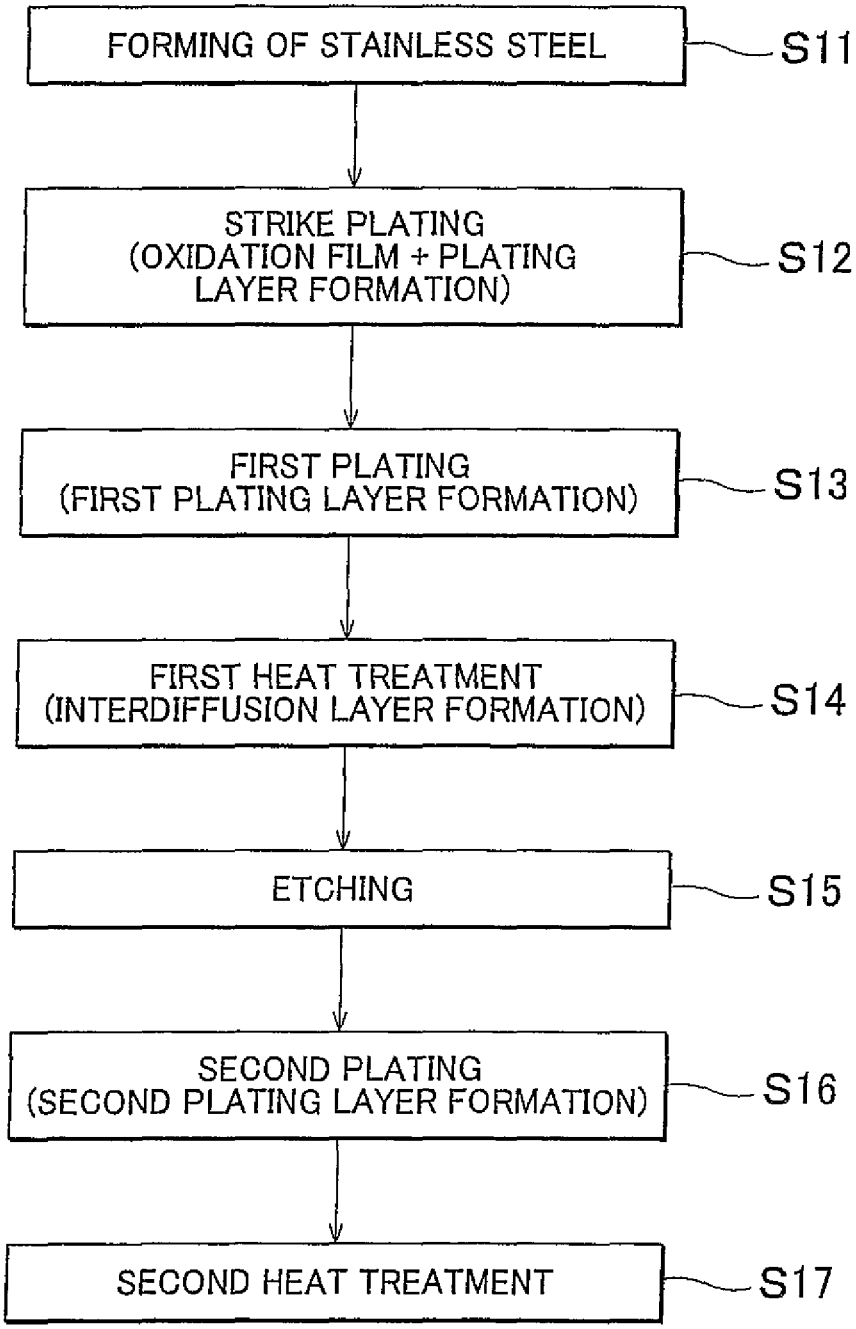
FIG. 1 is a flowchart explaining each step of a method of plating on a stainless steel substrate in accordance with an embodiment of the present invention.
Figure 2A:
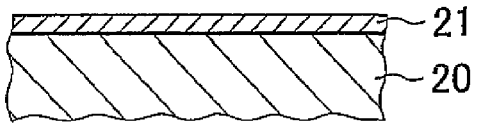
Figure 2B:
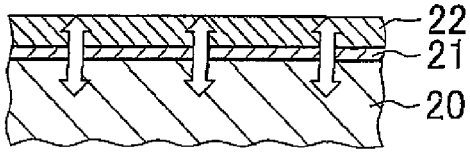
Figure 2C:
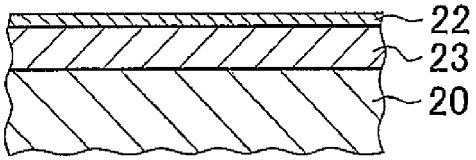
Figure 2D:
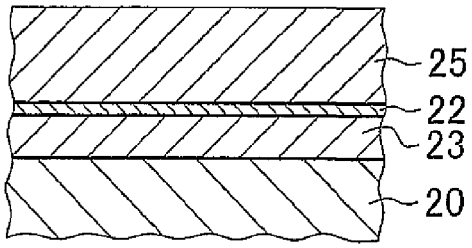
Figure 2E:
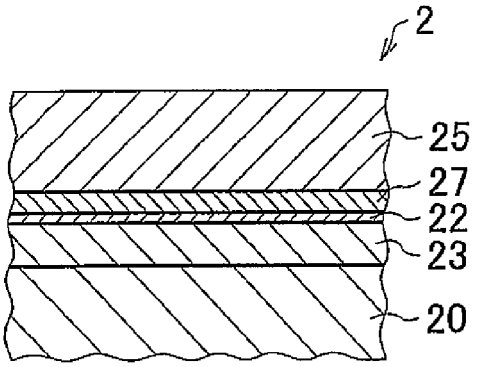

The present invention will be described hereinafter on the basis of an embodiment with reference to drawings. FIG. 1 is a flowchart explaining each step of a method of plating on a stainless steel substrate in accordance with the embodiment of the present invention. FIGS. 2A through 2E are schematic cross-sectional views of the stainless steel substrate in the steps shown in FIG. 1. FIG. 2A is a view illustrating a strike plating step. FIG. 2B is a cross-sectional view of the stainless steel substrate after a first plating step. FIG. 2C is a cross-sectional view of the stainless steel substrate after a first heat treatment. FIG. 2D is a cross-sectional view after a second plating step. FIG. 2E is a cross-sectional view after a second heat treatment. The steps in FIG. 1 will be described hereinafter with the respective cross-sectional views of the stainless steel substrate in FIGS. 2A-2E.

A forming step S11 for the stainless steel substrate is first conducted. Specifically, as the stainless steel to be plated, a raw material made of austenitic stainless steel (for example, JIS (Japanese Industrial Standards): SUS304, SUS316, or other) is prepared, and this stainless steel substrate may be formed into a desired product shape by press forming or the like.

A strike plating step S12 is next conducted as chemical plating. Specifically, the stainless steel substrate may be dipped into a nickel plating bath containing a strong acid solution (for example, hydrochloric acid) having nickel dissolved therein. Electric current of a specified current value is applied thereto for a specified period by electrolytic plating, thereby removing a passivation film (oxidation film) on the surface of the stainless steel substrate. As shown in FIG 2A, an electrolytic nickel strike plating layer 21 is at the same time deposited over the surface of a stainless steel substrate 20. Subsequently, the stainless steel substrate is washed with water and dried.

In a process for removing the passaivation film of the stainless steel substrate in a related art, when the stainless steel substrate is taken out from a treating bath (acid pickling bath) after the removal process, the passivation film starts self-repairing due to contact to oxygen in the atmosphere. However, in the above step, since the electrolytic nickel strike plating layer is formed before the self-repair starts, reproduction of the passivation film can be prevented. Accordingly, adhesion strength of the plating layer onto the surface of the stainless steel substrate can be improved.

It is desirable to apply such a process to stainless steels (for example, SUS316) or the like, which contain Mo or the like and thus are prone to formation of a stronger passivation film, among austenitic stainless steels. Further, in cases of other stainless steels (for example, SUS304 and others), only the removal of the passivation film (oxidation film) on the surface of the stainless steel substrate can be conducted by dipping the stainless steel substrate into a strong acid solution such as hydrochloric acid or sulfuric acid.

A first plating step S13 is next conducted. In this step, electroless nickel-boron (Ni—B) plating is conducted as chemical plating. Specifically, the stainless steel substrate is dipped into a plating liquid containing nickel sulfate, DMBA, organic acid, and other additives, and, as shown in FIG. 2B, a nickel-boron plating layer (first plating metal layer) 22 is coated over the surface of the electrolytic nickel strike plating layer 21.

Further, in this step, vibration may be applied to the stainless steel substrate while the stainless steel substrate is dipped into the plating liquid. This allows prevention of formation of pinholes due to hydrogen gas produced in the layer during the formation of the first plating metal layer 22.

A first heat treatment step S14 is next conducted. Specifically, the stainless steel substrate over which the nickel-boron plating layer (first plating metal layer) made of a boron-containing nickel alloy is washed by water and dried. Subsequently, the heat treatment is applied to the stainless steel substrate in a heating condition of vacuum atmosphere at temperature of 800-1100° C. for several hours (for example, a heating condition of 1080° C. for 6 hours).

Accordingly, as shown in FIG. 2B, nickel of the electrolytic nickel strike plating layer 21 and the first plating metal layer 22 diffuses from the interface of the stainless steel substrate into the interior thereof, and Fe, Cr, C, and others of the stainless steel substrate 20 diffuse from the interfaces of the electrolytic nickel strike plating layer 21 and the first plating metal layer 22 into the interiors thereof. As a result, as shown in FIG. 2C, an interdiffusion layer 23 in which the elements of the stainless steel substrate 20 and the elements of first plating metal layer 22 interdiffuse is formed between the stainless steel substrate 20 and the first plating metal layer 22.

At this point, the interdiffusion layer 23 is preferably formed such that the layer thickness of the interdiffusion layer 23 exceeds at least the maximum height of surface roughness of the stainless steel substrate 20. Accordingly, the interdiffusion layer 23 can uniformly cover the surface of the stainless steel substrate 20.

In this step, although the heat treatment is applied such that a part of the first plating metal layer 22 remains on the surface layer, the elements of the stainless steel may be diffused throughout the interior of the first plating metal layer 22. This allows not only uniform coverage of the surface of the stainless steel substrate 20 by the interdiffusion layer but also diffusion of the element (Fe) of the stainless steel to the surface of the first plating metal layer 22. As a result, adhesion strength of the second plating metal layer that is coated over the surface where iron is present can be enhanced compared to a surface shown in FIG. 2C where no iron is present.

An etching step S15 is next conducted. Specifically, the stainless steel substrate having the interdiffusion layer formed therein is sequentially washed by water, dipped into a hydrochloric acid solution, washed by water, and dried. Accordingly, oxides or the like on the surface of the plating layer can be removed, and adhesion of the second plating metal layer in later steps can be enhanced.

A second plating step S16 is next conducted. In this step, electroless nickel-phosphorus (Ni—P) plating is conducted as chemical plating. Specifically, the stainless steel substrate is dipped into a plating liquid containing nickel sulfate, sodium hypophosphite, organic acid, and other additives, and, as shown in FIG. 2D, a nickel-phosphorus plating layer (second plating metal layer) 25 made of amorphous phosphorus-containing nickel (Ni—P) is coated over the surface of the first plating metal layer 22 to a thickness of several tens μm. In this step also, vibration may be applied to the stainless steel substrate while the stainless steel substrate is dipped into the plating liquid.

A second heat treatment step S17 is finally conducted. In this step, the stainless steel substrate after the second plating is washed by water and dried, and subsequently the second heat treatment is applied to the stainless steel substrate in a heating condition of a temperature of 300° C. or less for several hours (for example, a condition of 280° C. for 1 hour).

Accordingly, as shown in FIG. 2E, a diffusion layer 27 having nickel and phosphorus of the second plating metal layer 25 diffused therein can be formed with preventing crystallization of amorphous phosphorus-containing nickel and keeping its amorphous state. Further, this allows a reduction in corrosion due to pinholes formed in each of the plating layers 22, 25, the interdiffusion layer 23, and diffusion layer 27.

The series of steps described above allows obtainment of a plated material 2 having the interdiffusion layer 23 in which, as shown in FIG. 2E, Fe, Cr, and C of the stainless steel and nickel of the first plating metal layer (nickel-boron plating layer) 22 interdiffuse between the austenitic stainless steel substrate 20 and the second plating metal layer (nickel-phosphorus plating layer) 25.

In the plated material 2 in which plating is applied to the stainless steel substrate 20 and which is obtained in the above steps, the alloy metal containing Fe, Cr, and Ni that form the interdiffusion layer 23 is a baser metal (metal having a higher ionization tendency) than nickel of the second plating metal layer 25, and thus the interdiffusion layer 23 serves as a sacrificial corrosive layer. Accordingly, the interdiffusion layer 23 first corrodes before corrosion progresses to the stainless steel substrate 20. As a result, since corrosion progresses in the direction along the surface of the stainless steel substrate 20, corrosion in the thickness direction of the stainless steel substrate 20, that is, pitting corrosion of the stainless steel substrate 20 can be prevented.

The present invention will be described hereinafter with following examples. The present invention is not limited to the following examples.

Example 1

A plated material (test sample) in which plating was applied to a stainless steel was fabricated as described in the following.

[Passivation Film Removal Step]

As a stainless steel to be plated, an austenitic stainless steel (JIS: SUS304) of 40 mm×40 mm×0.8 mm thickness was prepared. Next, as a pretreatment, the stainless steel substrate was washed by water, dipped into a hydrochloric acid solution of a concentration of 210 g/L at 45° C. for 3 minutes, subsequently washed by water, and further dipped into a sulfuric acid solution of a concentration of 210 g/L at 60° C. for 1 minute. Passivation films on the surface of the stainless steel substrate was thereby removed.

[First Plating Step]

Next, electroless Ni—B plating was conducted as a first plating step. Specifically, an Ni—B plating liquid (Okuno Chemical Industries Co., Ltd.: Top Chem Alloy 66-LF) made of 25 g/L of nickel sulfate, several g/L of DMBA, 10 g/L of organic acid, and other additives was adjusted to Ni concentration of 5.5-6.5 g/L, pH of 6.0-6.5, at temperature of 64° C., and in this solution an electroless Ni—B plating layer (first plating metal layer) was coated over the surface of the stainless steel substrate with vibration applied to the stainless steel substrate until the layer thickness reaches 3 μm. The stainless steel substrate was then washed by water and hot water and dried.

[First Heat Treatment Step]

Next, the stainless steel substrate was put in a heating furnace and underwent a heat treatment in a vacuum atmosphere at 1080° C. for 6 hours. Nickel was thereby diffused into the stainless steel, forming an interdiffusion layer having at least iron and chromium diffused therein in the electrolytic Ni—B plating layer. It was confirmed that a 15 μm interdiffusion layer was formed by EDX analysis on the test sample obtained through the following series of steps:

[Etching Step]

Next, as a pretreatment, the stainless steel substrate was washed by water, dipped into a hydrochloric acid solution of a concentration of 210 g/L at 45° C. for 3 minutes, subsequently washed by water, and further dipped into a sulfuric acid solution of a concentration of 210 g/L at 60° C. for 1 minute. Oxides on the surface of the plating layer (interdiffusion layer) were thereby removed.

[Second Plating Step]

Next, electroless Ni—P plating was conducted as a second plating step. Specifically, an electroless Ni—P plating liquid (Okuno Chemical Industries Co., Ltd.: Top Nicoron NAC) made of 25 g/L of nickel sulfate, 15 g/L of sodium hypophosphite, 10 g/L of organic acid, and other additives was adjusted to Ni concentration of 5.2-6.8 g/L, pH of 4.4-4.8, at temperature of 84° C., and in this solution an electroless Ni—P plating layer (second plating metal layer) is coated over the plating layer (interdiffusion layer) with vibration applied to the stainless steel substrate until the layer thickness reaches 30 μm. Subsequently, the stainless steel substrate was washed by water and hot water.

[Second Heat Treatment Step]

The stainless steel substrate having the electroless Ni—P plating layer coated thereon is heated in a temperature condition of 280° C. for 1 hour. The test sample of the plated material in accordance with example 1 was obtained through the above series of steps.

Example 2

A plated material was fabricated in a manner similar to the example. This plated material differs from Example 1 in that an austenitic stainless steel (JIS: SUS316) further containing Mo was used as the stainless steel substrate and a strike plating step was conducted instead of the passivation film removal step. Specifically, the stainless steel was dipped into a solution of Ni concentration of 60 g/L and hydrochloric acid concentration of 35 g/L and underwent removal of passivation films by application of electric current of 1.5 A/dm$^2$ for 5 minutes at room temperature. The surface of the stainless steel substrate from which the passivation films had been removed was coated with an electrolytic strike plating layer to a thickness of 0.3 μm.

Comparative Example 1

A stainless steel (JIS: SUS304) same as Example 1 was prepared and used as a test sample. In other words, in Comparative Example 1, plating was not applied to the stainless steel substrate.

Comparative Example 2

A stainless steel (JIS: SUS316) same as Example 2 was prepared and used as a test sample. In other words, in Comparative Example 2, plating was not applied to the stainless steel substrate.

Comparative Example 3

A stainless steel same as Example 1 was prepared. In the plating on this stainless steel substrate, only the passivation film removal step, the second plating step, and the second heat treatment of Example 1 were conducted. In other words, Comparative Example 3 differs from example 1 in that the first plating and the first heat treatment were not conducted (no interdiffusion layer was formed.)

<Anticorrosion Test 1>

Figure 3A:
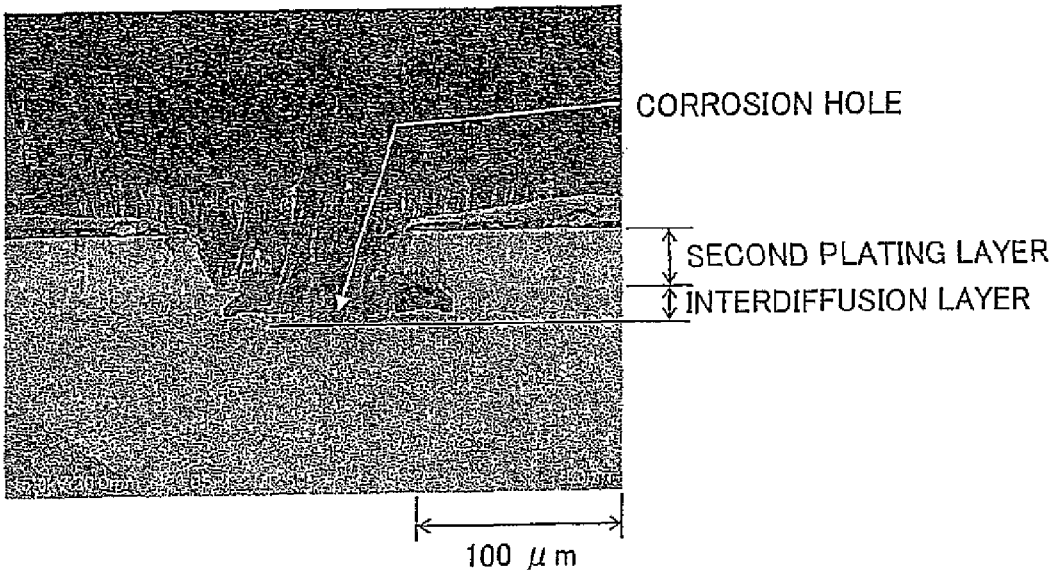
Figure 3B:
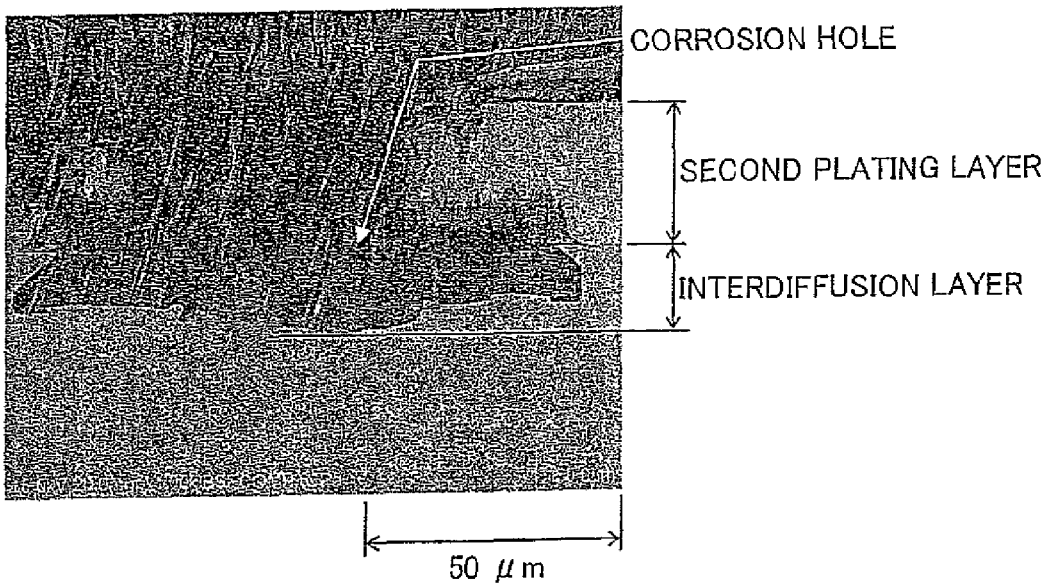
Figure 5:
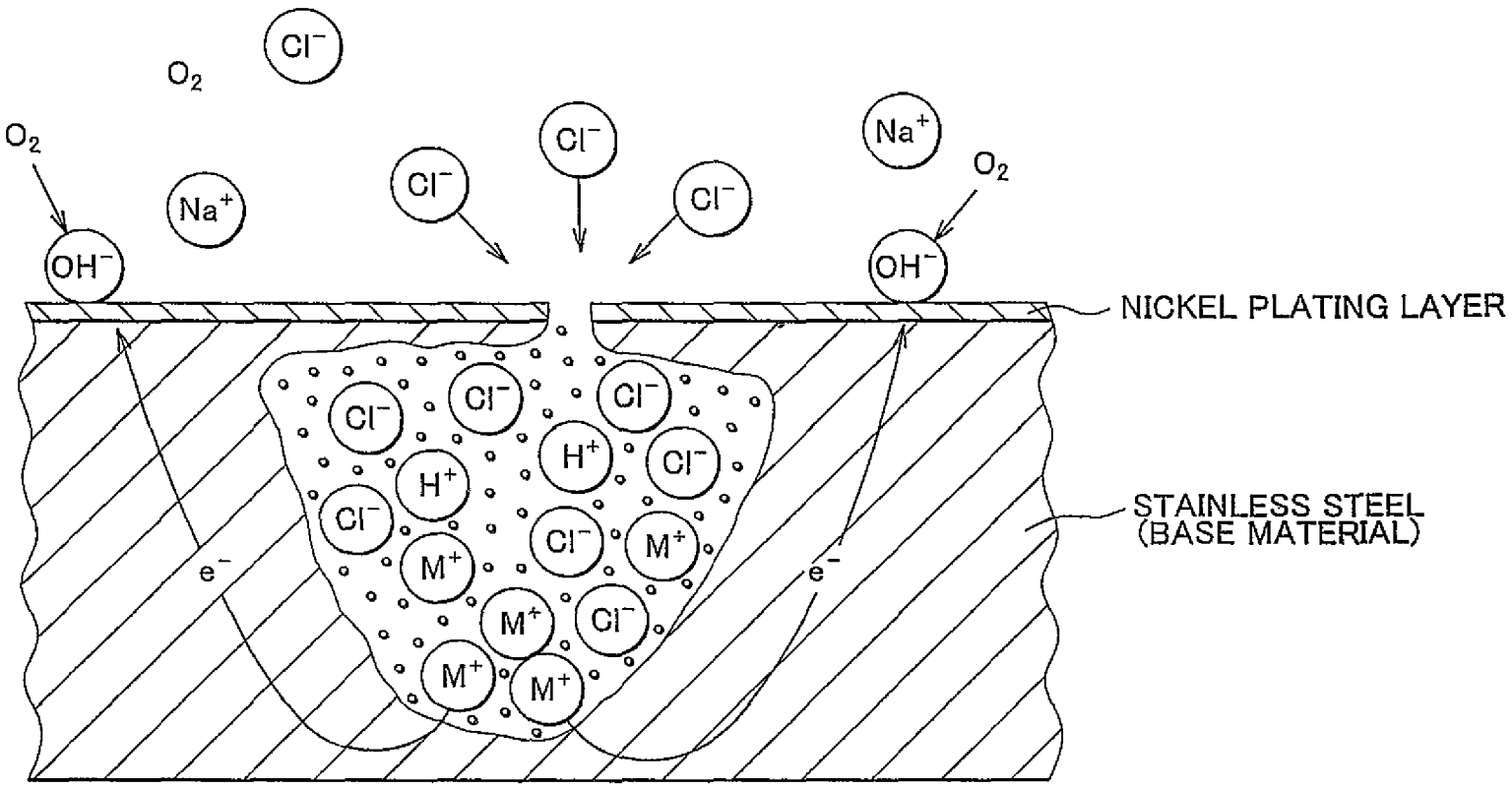
FIG. 5 RELATED ART
FIG 5 is a view illustrating a corrosion state of a plated material in which a stainless steel substrate is plated in accordance with a related art.

A corrosion test liquid at a pH of 2 which is a mixture of hydrochloric acid and sulfuric acid solutions was prepared. Each test sample of Examples 1, 2 and Comparative Examples 1-3 was dipped into the solution warmed to 90° C. for 6 hours. Those test samples were then taken out, cooled for 1 hour, and left in the atmosphere in wet states for 17 hours. The corrosion state of the surface of each test sample was observed with an SEM. FIGS. 3A and 3B are cross-sectional views of the plated material in accordance with Example 1 after an anticorrosion test. FIG. 3A is a cross-sectional photograph of a vicinity of a corrosion hole. FIG 3B is an enlarged photograph of FIG. 3A.

<Anticorrosion Test 2>

Corrosion test liquids at pHs of 3.5 and 7.0 which are mixture of hydrochloric acid and sulfuric acid solutions were prepared. Each test sample of Example 1, Comparative Examples 1 and 2 was dipped into the solutions warmed to 90° C. for 6 hours. Those test samples were then taken out, cooled for 1 hour, and left in the atmosphere in wet states for 17 hours. Setting these steps as 1 cycle, the test was carried out for continuous 8 cycles (8 days). Subsequently, the maximum corrosion depths in the stainless steels (base materials) after the test were measured. FIG. 4 shows the results. The maximum corrosion depths are the maximum value of corrosion depth from the interface between the interdiffusion layer and the stainless steel base material in Example 1 and the maximum values of corrosion depth from the interface between the passivation films and the stainless steel base materials in Comparative Examples 1 and 2.

<Result 1>

As shown in FIGS. 3A and 3B, in the test sample of Example 1, although corrosion of the interdiffusion layer was found, little corrosion was found in the stainless steel (base material). An EPMA analysis was conducted for confirmation of the result, and a similar result was obtained. A similar result was also obtained on the test sample of Example 2. However, in Comparative Examples 1-3, pitting corrosion was found in the stainless steel base materials.

<Result 2>

As shown in FIG. 4, in the test sample of Example 1 tested with the corrosion test liquid (pH 3.5), although corrosion of the interdiffusion layer was found, little corrosion was found in the stainless steel (base material). On the test with the corrosion solution (pH 7), even no corrosion of the plating layer was found, and no rust occurred. On the other hand, in the test samples of Comparative Examples 1 and 2, pitting corrosion was observed in the stainless steel base materials. Each of the test samples had the maximum corrosion depth of 70 μm or greater with the corrosion test liquid (pH 3.5) and the maximum corrosion depth of 40 μm or greater with the corrosion test liquid (pH 7.0).

On the basis of the results 1 and 2, it is considered that since the alloy metal containing Fe, Cr, and Ni that form the interdiffusion layer is a baser metal (metal having a higher ionization tendency) than nickel in the second plating metal layer in the test sample of Example 1, the interdiffusion layer served as a sacrificial corrosive layer, and thus the interdiffusion layer first corroded before corrosion progressed to the stainless steel (base material). As a result, it is considered that corrosion progressed in the direction along the surface of the stainless steel, thus preventing pitting corrosion in the stainless steel.

In this embodiment, the first and second plating steps are conducted by electroless plating. Electroless plating is effective to uniformly coat the plating layer in a case that the stainless steel has a complicated shape. However, electrolytic plating may be used in a case that the stainless steel has a simple shape (plate shape or the like).

Further, in this embodiment, all plating is conducted by wet plating. However, if the plating enables formation of the interdiffusion layer, obtainment of corrosion resistance of the plating layer, and prevention of intergranular corrosion of the stainless steel, at least a part of the plating may be conducted by dry-process plating or the like such as hot dip coating, sputtering, or vapor deposition.

While the invention has been described with reference to example embodiments thereof, it is to be understood that the invention is not limited to the described embodiments or constructions. To the contrary, the invention is intended to cover various modifications and equivalent arrangements. In addition, while the various elements of the disclosed invention are shown in various example combinations and configurations, other combinations and configurations, including more, less or only a single element, are also within the scope of the appended claims.

The invention claimed is:

1. A method of plating a stainless steel, comprising:

depositing a first plating metal layer over a stainless steel substrate, wherein the plating metal of the first plating metal layer is formed of a boron-containing nickel alloy;

forming an interdiffusion layer in which at least iron and chromium of the stainless steel substrate and nickel and boron of the first plating metal layer interdiffuse, by applying a heat treatment to the stainless steel substrate coated by the first plating metal layer; and depositing a second plating metal layer over the stainless steel substrate having the interdiffusion layer formed therein, wherein the second plating metal layer is formed of phosphorous-containing nickel, wherein the stainless steel is selected from the group consisting of ferritic stainless steel, austenitic stainless steel and martensitic stainless steel, and wherein the stainless steel substrate is heated at 300° C. or lower after deposition of the second plating metal layer.

2. The method according to claim 1, wherein the elements of the stainless steel substrate diffuse through the entirety of first plating metal layer during formation of the interdiffusion layer.

3. The method according to claim 1, further comprising:

removing a passivation film that is formed on a surface of the stainless steel substrate by electrolytic plating and depositing a plating metal layer of the same kind of plating metal as the first plating metal layer before the first plating metal layer is deposited.

4. The method according to claim 1, wherein the stainless steel substrate is formed of an austenitic stainless steel, and the heat treatment is applied by heating the stainless steel substrate at a temperature in a range of 800° C. to 1100° C. in the forming of the interdiffusion layer.

5. The method according to claim 1, wherein the stainless steel substrate is heated at 150° C. or higher after deposition of the second plating metal layer.

6. The method according to claim 1, further comprising:

etching the stainless steel substrate having the interdiffusion layer before the second plating layer is deposited.

* * * * *